United States Patent [19]

Roos

[11] 4,434,570

[45] Mar. 6, 1984

[54] ADVERTISING HOLDER

[75] Inventor: Johannes Roos, Wateringen, Netherlands

[73] Assignee: Rollex B.V., The Hague, Netherlands

[21] Appl. No.: 376,449

[22] Filed: May 10, 1982

[51] Int. Cl.[3] ..... G09F 1/12

[52] U.S. Cl. ..... 40/617

[58] Field of Search ..... 40/606, 617, 624, 584; 248/320, 330.1, 38, 39

[56] References Cited

U.S. PATENT DOCUMENTS

| | | | |
|---|---|---|---|
| 423,873 | 3/1890 | Kinney et al. | 248/320 |
| 662,089 | 11/1900 | Pettey | 40/617 |
| 2,144,397 | 1/1939 | Taddonio | 248/320 |

*Primary Examiner*—Gene Mancene
*Assistant Examiner*—Wenceslao J. Contreras
*Attorney, Agent, or Firm*—George E. Kersey; Arthur B. Moore; Barry D. Josephs

[57] ABSTRACT

The holder is suspended from a surface, such as a ceiling, at a level which is adjustable by a user. As a result, the holder can be lowered to a convenient level for replacement of the advertising material and thereafter raised to an appropriate display level.

10 Claims, 8 Drawing Figures

ADVERTISING HOLDER

BACKGROUND OF THE INVENTION

This invention relates to holders and more particularly to holders for advertising and other display materials.

In the marketing of products it is common practice to use advertising displays which are changed according to market conditions. A common example is the supermarket in which "specials" are advertised on large plaques or posters which are mounted on the windows or the walls of the store.

Once particular store located advertisements have served their purposes they are removed or replaced. This typically requires resort to ladders and other mounting devices, since the posted materials are typically near ceiling level in order to provide the greatest visual contact with patrons of the store.

The need for mounting devices and the like is not only inconvenient, it is labor intensive; it often interferes with the flow of customer traffic in the store. It also is inconvenient since it hinders the rapid and efficient replacement of advertising displays that have served their purpose and should be changed.

Accordingly, it is an object of the invention to facilitate the displays of advertising materials, particularly plaques and posters which are intended to be at elevated levels in order to provide a maximum visual communication with the patrons of the store.

Another object of the invention is to avoid the need for ladders and access devices in changing advertising posters and plaques which have served their purposes.

Still another object of the invention is to permit a rapid change in advertising information without requiring the use or the need for auxiliary devices such as stepladders and the like.

SUMMARY OF THE INVENTION

In accomplishing the foregoing and related objects the invention provides an advertising holder which can be selectively adjusted with respect to a viewer and carries an advertising appendage, such as a plaque, which can be replaced as desired.

In accordance with one aspect of the invention the holder includes a housing that contains a mechanism for controllably suspending the housing from a surface such as a ceiling. The housing additionally includes, preferably on its underside, a mechanism for releaseably securing advertising material to the housing.

Because of the controllable suspension, the housing can be raised or lowered to any desired level. When the housing is suspended from a ceiling, it can be pulled downwardly to near floor level to permit rapid change of the advertising material. In addition, during the course of a particular advertising campaign the holder can easily be raised or lowered to different levels as desired to promote customer attentiveness.

In accordance with another aspect of the invention the housing includes a spring loaded cylinder with one or more attached cables for use in regulating the position of the housing. It is desirable to employ at least two separate cables which are interlocked in order to promote horizontal stabilization of the housing at different elevational levels.

In accordance with still another aspect of the invention the advertising material is secured to the housing by one or more spring loaded clips. Each clip advantageously contains a multisegment spring element, for example, in a substantially z-shaped configuration. The cylinder also includes a control ratchet in order to provide for ready release when its position is to be changed and also to secure the cylinder at a desired elevational level according to the manipulation of the user.

DESCRIPTION OF THE DRAWINGS

Other aspects of the invention become apparent after considering several illustrative embodiments taken in conjunction with the drawings in which.

DETAILED DESCRIPTION

Figure 1:
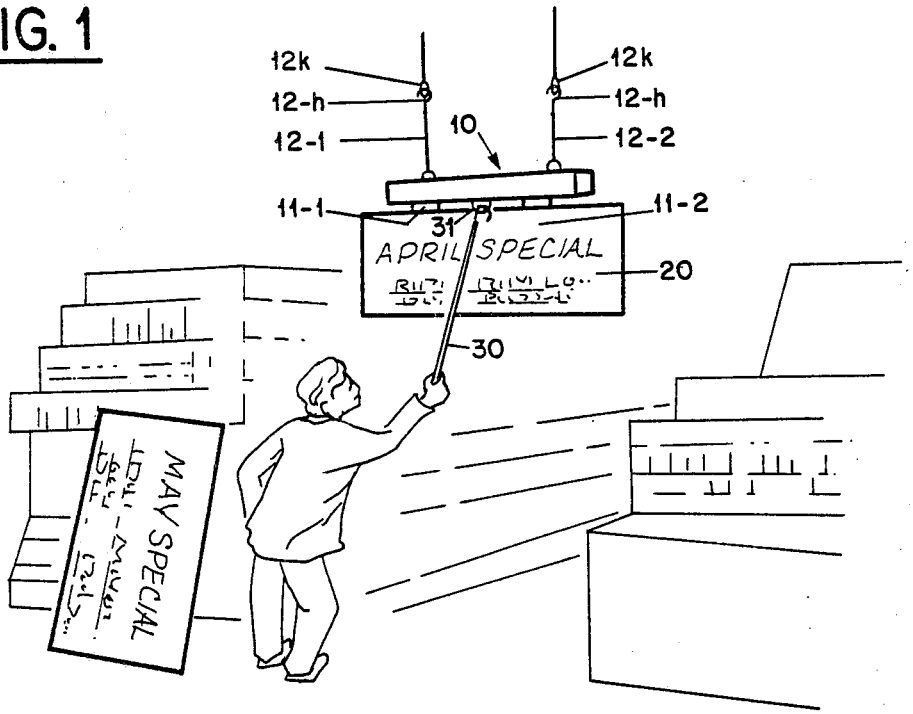
FIG. 1 is a perspective view showing a ceiling suspended advertising holder in accordance with the invention.

With reference to the drawings, FIG. 1 shows an advertising holder 10 carrying an advertising sheet 20 by clips 11-1 and 11-2, and suspended from a store ceiling C, with an employee E in the course of lowering the housing 10 in order to change the placard 20. The housing 10 is supported from the ceiling C by wire cables 12-1 and 12-2. The end of each of the cables 12-1 and 12-2 includes a hanger **12*h* which engages with a mating hook 12*k* mounted in the ceiling C. The lower part of the housing 10 includes an eye bar 13 which is adapted to be engaged by the hooked end of a probe 30. The hook 31 is at the end of the probe 30 opposite the grip 32 and is enterable into the curved eye bar 13 of the housing 10**.

Figure 2:
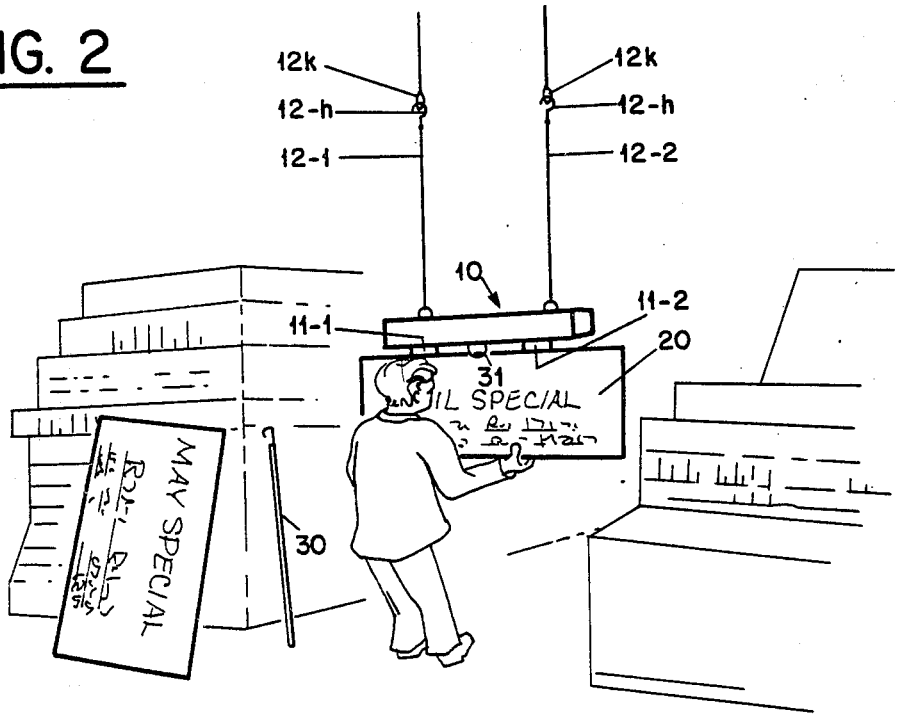
FIG. 2 is a further view of FIG. 1 showing the advertising holder lowered to a level where an advertising display sheet is easily changed.

As indicated in FIG. 2 the user E pulls on the eye bar 13 of the housing 10 using the probe 30 until the housing 10 reaches a convenient level. The placard 20 can then be replaced by a suitable substitute, for example placard 21 shown to the left of the user E in both FIGS. 1 and 2.

Once the placards 20 and 21 have been interchanged, with the replacement placard being releaseably held by the clips 11-1 and 11-2, the holder 10 is repositioned to a desired level, for example, near the ceiling as shown in FIG. 1.

The return action of the housing is accomplished by pulling downwardly on the probe 30 to release a ratchet (described below) and allow recall of the holder to the desired level. A momentary interruption in the upward travel, by a downward pull on the probe 30, causes a pawl of the ratchet to lockingly engage an internal control element of the housing 10.

Figure 3:
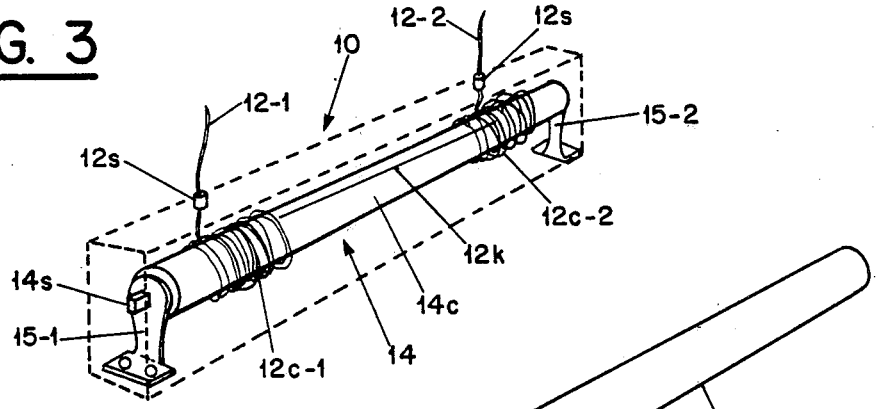
FIG. 3 is an interior view of the holder showing control mechanism for elevating and lowering the housing of FIGS. 1 and 2.

The internal mechanism that controls the level of the housing 10 is shown in FIG. 3 with the cover 16 of the housing 10 illustrated in phantom. The control mechanism is a spring loaded cylinder 14 supported at opposite ends by members 15-1 and 15-2. Both of the latter are secured to a mounting surface of the housing 10 by convenient fasteners, such as screws. The control member 14 includes an outer cylinder **14*c* that is rotatable with respect to a central shaft 14*s*. The latter extends into outward engagement with the members 15-1 and 15-2. The rotatable cylinder 14*c* includes separate connections to the cables 12-1 and 12-2. Each of the cables 12-1 and 12-2 is provided with a stopper 12*s* to establish a minimum downward displacement for the housing 10**.

In addition, the cables 12-1 and 12-2 are coiled about the cylindrical surface **14*c* and include an interlock 12*k* to promote uniformity in the distribution of the coils 12*c*-1 and 12*c*-2 that form on the rotatable cylinder 14*c* as the housing 10** is elevated and lowered.

Figure 4:
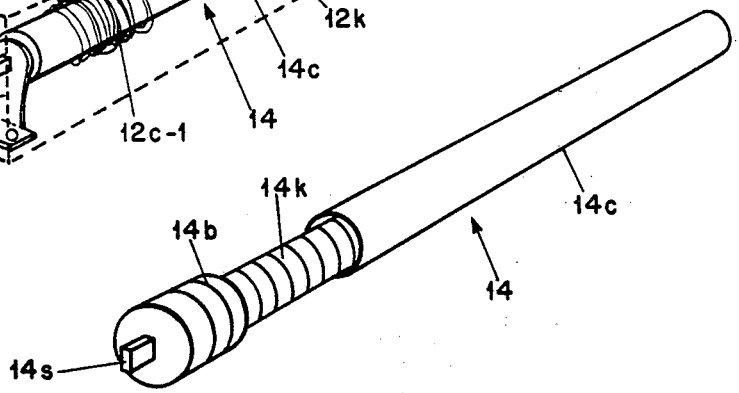
FIG. 4 is a perspective view of a spring loaded cylinder used in the control mechanism of FIG. 3.

The internal mechanism of the control member 14 is illustrated in FIG. 4 where the rotatable sleeve **14*c* is shown separated from its mounting bushing 14*b* at opposite ends of the support rod 14*s*. The latter includes a coil spring 14*k* which is secured to the bushing 14*b* so that when the sleeve 14*c* is in engagement with the bushing 14*b*, rotation of the sleeve 14*c* produces a winding (or unwinding) effect on the coil spring 14*k***.

Figure 5A:
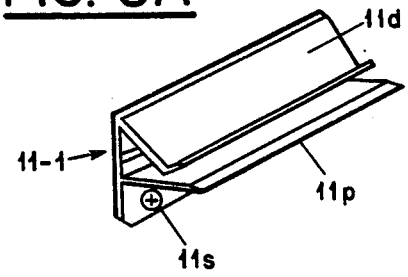
FIG. 5A is a perspective view of a display mounting clip for the housing of FIGS. 1 and 2.
Figure 5B:
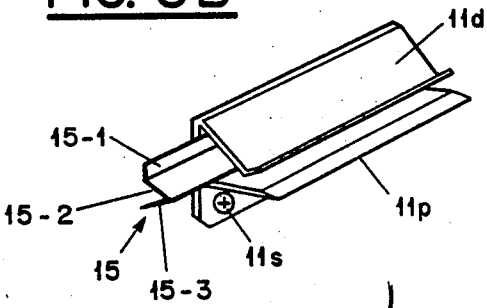
FIG. 5B is a further view of FIG. 5A showing an internal multisegment leaf spring in the course of being removed.
Figure 5C:
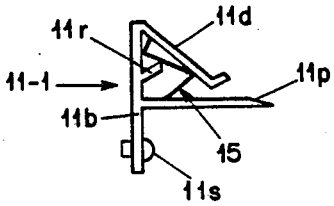
FIG. 5C is a cross sectional view of FIG. 5B.

The clips 11-1 and 11-2 that are used to releaseably secure advertising material to the lower side of the housing 10 are illustrated by the clip 11-1 in FIGS. 5A through 5C. The clip 11-1 includes a base **11*b* which is secured to the lower side of the housing 10 by any convenient fastener, for example, screws 11*s*. The clip 11-1 also includes a central projection 11*p* which extends outwardly from the base 11*b*. One end of the base 11*b* includes a diagonal member 11*d* that extends outwardly at an angle of about 45° to near the end of the projection 11*p*. The open triangular closure formed by the base 11*b*, the projection 11*p* and the diagonal member 11*d* includes an angled retainer 11*r* that holds an internal leaf spring 15 within the clip 11-1**.

As can be seen in FIGS. 5B and 5C the leaf spring 15 is formed by a plurality of segments, in particular a central segment 15-2 and end segments 15-1 and 15-3. The segments 15-1 through 15-3 collectively form a substantially z-shaped leaf spring as indicated in FIG. 5C.

Figure 5D:
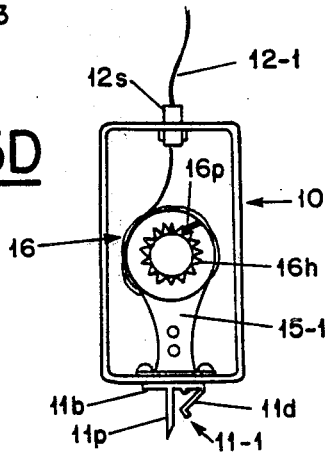
FIG. 5D is an end view corresponding to FIG. 3 showing the roller and associated ratchet mechanism of the advertising housing.

The ratchet mechanism 16 that is employed in the controlled lowering and elevation of the housing 10 is illustrated in FIG. 5B. The ratchet includes a toothed hub **16*h* and the pawl 16*p*. When the housing 10 is pulled downwardly in the direction indicated by the arrow A in FIG. 5D the pawl 16*p* is momentarily released from engagement with one of the teeth of the hub 16*h*. Release of the housing 10 then permits upward movement in the direction indicated by Arrow B until there is a momentary termination in the upward movement, allowing the pawl 16*p* to engage one of the teeth of the hub 16*h* and terminate the upward movement of the housing 10 at the position desired by the user E (FIGS. 1 and 2**).

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims.

I claim:

1. An advertising holder comprising a housing;

movable suspension means for controllably suspending said housing from a surface;

means for releaseably securing an advertising appendage to said housing whereby the position of said advertising appendage can be selectively adjusted with respect to a viewer and said appendage can be replaced as desired;

wherein the movable suspension means includes a spring loaded cylinder contained within said housing for regulating the position of said housing.

2. An advertising holder as defined in claim 1 wherein the movable suspension means includes a wire cable secured to and envelopeable about said cylinder.

3. An advertising holder as defined in claim 2 wherein said suspension means includes a plurality of wire cables secured to said cylinder.

4. An advertising holder as defined in claim 3 wherein said wire cables are interlocked on said cylinder.

5. An advertising holder as defined in claim 1 wherein the securing means comprises a spring loaded clip.

6. An advertising holder as defined in claim 5 wherein said securing means comprises a plurality of spring loaded clips.

7. An advertising holder as defined in claim 6 wherein each clip includes a removable multisegment spring element.

8. An advertising holder as defined in claim 7 wherein the segments are arranged in a substantially z-shaped configuration.

9. An advertising holder as defined in claim 3 wherein the cylinder includes a control ratchet at one end thereof.

10. An advertising holder as defined in claim 9 wherein the cylinder includes an internal axial support with a coil spring secured thereto.

* * * * *